US007221353B2

(12) United States Patent
Kim et al.

(10) Patent No.: US 7,221,353 B2
(45) Date of Patent: May 22, 2007

(54) LIQUID CRYSTAL DISPLAY DEVICE AND METHOD FOR OPERATING THE SAME

(75) Inventors: Wook Sung Kim, Kyonggi-do (KR); Jong Jin Park, Seoul (KR); Hyeon Ho Son, Kyonggi-do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 511 days.

(21) Appl. No.: 10/329,483

(22) Filed: Dec. 27, 2002

(65) Prior Publication Data

US 2003/0122755 A1 Jul. 3, 2003

(30) Foreign Application Priority Data

Dec. 29, 2001 (KR) ..... P 10-2001-0088416

(51) Int. Cl.
*G09G 5/00* (2006.01)

(52) U.S. Cl. ..... 345/102; 345/87; 345/204; 345/214; 362/26; 362/27; 362/31

(58) Field of Classification Search ..... 345/55, 345/84, 87, 98, 100, 104, 204, 213, 214; 348/790; 362/26, 27, 33, 31
See application file for complete search history.

(56) References Cited

U.S. PATENT DOCUMENTS 33,740 A * 11/1861 Taguchi et al. ..... 111/130
5,070,431 A * 12/1991 Kitazawa et al. ..... 362/31
5,095,459 A * 3/1992 Ohta et al. ..... 706/40
5,655,165 A * 8/1997 Takahashi et al. ..... 396/315
5,867,141 A * 2/1999 Asada et al. ..... 345/100
5,898,510 A * 4/1999 Kaihotsu et al. ..... 358/509
6,046,732 A * 4/2000 Nishimoto ..... 345/168
6,069,603 A * 5/2000 Knapp ..... 345/91
6,326,939 B1 * 12/2001 Smith ..... 345/84
6,396,469 B1 5/2002 Miwa et al. ..... 345/87
2001/0042990 A1 * 11/2001 Ito et al. ..... 296/70
2006/0139289 A1 6/2006 Yoshida et al.

FOREIGN PATENT DOCUMENTS

JP 11-109921 4/1999
JP 2000-275604 10/2000
KR 10-2001-0039573 5/2001

* cited by examiner

*Primary Examiner*—Bipin Shalwala
*Assistant Examiner*—Vincent E. Kovalick
(74) *Attorney, Agent, or Firm*—Morgan, Lewis & Bockius LLP

(57) ABSTRACT

A liquid crystal display (LCD) including an LCD panel having a plurality of gate lines running in parallel in one direction and a plurality of data lines running in parallel perpendicular to the gate lines, gate input drivers for providing gate signals to the gate lines of the LCD panel, data input drivers for providing data signals to the data lines of the LCD panel and a back light unit on a lower part of the LCD panel having a light guide plate and at least two light emitting elements in the same plane with the light guide plate on opposite sides of the light guide plate, wherein the two light emitting elements are turned on and off alternately with respect to each other.

17 Claims, 7 Drawing Sheets

LIQUID CRYSTAL DISPLAY DEVICE AND METHOD FOR OPERATING THE SAME

This application claims the benefit of the Korean Application No. P2001-88416 filed in Korea on Dec. 29, 2001, which is hereby incorporated by reference in its entirety.

BACKGROUND OF THE INVENTION

1. Field of the Invention

The present invention relates to a method for operating a liquid crystal display, and more particularly, to a method for operating a liquid crystal display (LCD) to prevent the appearance of blur.

2. Background of the Related Art

In general, an LCD has a system of cells in which a thin film transistor (TFT) is positioned in each cell of the LCD. A large-sized LCD having a large number of cells has been the subject of research because it has a high contrast ratio with a wide and linear gray scale capability for a moving image. Moreover, a large-sized LCD has application to large displays, such as High Definition Television (HDTV) because a large-sized LCD can be fabricated such that all of the cells are operational resulting in a high picture quality.

A related art LCD will be explained, with reference to the attached drawings. FIG. 1 illustrates a block diagram of a related art LCD. The related art LCD shown in FIG. 1 is provided with a Low Voltage Differential Signaling (LVDS) module 1 for receiving a picture data for an LCD panel 2 and providing data enable signals, vertical synchronizing signals, horizontal synchronizing signals and a system clock to a timing controller 3. In addition, the LVDS 1 provides picture data to a memory part 5 of the system. Data signals are provided to a data driving part 8 of the LCD panel 2 and the gate signals are provided to a gate driving part 9 of the LCD panel 2 by the timing controller 3 in response to the data enable signals, vertical synchronizing signals, horizontal synchronizing signals and the system clock. The data driving part provides data to the cells 7 of the LCD panel 2 while the gate driving part 9 drives gates of TFTs in the cells 7 of the LCD panel 2 such that cells 7 receive data. The memory part 5 receives the data signals from the timing controller part 3 and also receives picture data from the LVDS 1. The picture data is R, G, and B data. Using the picture data and the data signals, the memory part 5 provides even and odd numbered signals required for driving data in the data driving part 8 of the LCD panel 2.

The LCD panel 2 is provided with a plurality of gate lines 10 and a plurality of data lines 11 formed in a matrix shape that define the cells 7 of the LCD panel 2. Each cell has a TFT (not shown) connected to a pixel electrode. A back light 15 that can be a light conduit type is formed on a lower side of the LCD panel 2 for illuminating all of the cells on the back side of the LCD panel 2. The data level or voltage value of the data supplied to the pixel electrode through the TFT determines the amount of light transmittance that will occur through the cell from the back light unit 15.

FIG. 2 depicts a timing diagram for the related art LCD illustrated in FIG. 1. The timing for the related art LCD shown in FIG. 1 will be explained briefly. Although, in general, the timing of a gate signal, such as a scanning signal, varies with a resolution of the LCD, the timing diagrams for operating the related art LCD will be explained based on five scanning signals to simplify explanation. FIG. 2 illustrates a timing diagram for the related art LCD illustrated in FIG. 1. Referring to FIG. 2, the gate driving part 9 provides gate signals G1, G2, G3, G4 and G5 to the gate lines 10 for turning on the TFTs while the data driving part 8 provides data signals D to data lines 11. More specifically, the gate signals turn on and then turn off each TFT in sequence such that the data signals D are transmitted through the TFTs to the cells of the LCD panel only when the TFTs are turned on. On a screen for displaying an image, all of the gate lines are sequentially scanned such that all of the TFTs for the cells of the LCD panel are turned on and then turned off during one frame period.

The related art LCD has a problem in that images of a first frame overlap into a second frame due to the response time of a cell when data for a cell is changed to new data in the next frame period since light can still momentarily transmit through the cell. FIG. 3 illustrates the response of a cell changing from one data state to another data state. As shown in FIG. 3, the cell has a first frame period 1*f* that has a first data level D1. Subsequently, the data in the cell is changed to a second data level D2 during a second frame period 2*f*. However, there is a delay in the cell transferring from the first data level D1 to the second data level D2 that causes the appearance of blur on the screen. It is appearance of this blur caused by the delay in a cell transferring from one data level to another data level that impedes the use of an LCD panel as a HDTV.

SUMMARY OF THE INVENTION

Accordingly, the present invention is directed to a method for operating a liquid crystal display (LCD) that substantially obviates one or more of the problems due to limitations and disadvantages of the related art.

An object of the present invention is to provide a method for operating an LCD, which prevents the appearance of blur in an LCD panel.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display (LCD) including an LCD panel having a plurality of gate lines running in parallel in one direction and a plurality of data lines running in parallel perpendicular to the gate lines, gate input drivers to provide gate signals to the gate lines of the LCD panel, data input drivers to provide data signals to the data lines of the LCD panel and a back light unit on a lower part of the LCD panel having a light guide plate and at least two light emitting elements in the same plane with the light guide plate on opposite sides of the light guide plate, wherein the two light emitting elements are turned on and off alternately with respect to each other.

In another aspect, a method for operating an LCD includes providing a first gate signal to the plurality of gate lines sequentially and a second gate signal to the plurality of the gate lines sequentially after a set time period from the first gate signal within a frame period, providing picture data signals to a plurality of pixels in synchronization with the first gate signals provided to the plurality of pixels, providing black data signals to the plurality of pixels in synchronization with the second gate signals provided to the plurality of pixels and controlling at least two light emitting elements that are spaced apart from each other and on the same plane in a lower part of the LCD panel such that the at least two light emitting elements are turned on and off alternately with respect to each other.

In another aspect, a liquid crystal display (LCD) includes an LCD panel having a plurality of gate lines running in parallel in one direction and a plurality of data lines running in parallel perpendicular to the gate lines, gate input drivers to provide gate signals to the gate lines of the LCD panel, data input drivers to provide data signals to the data lines of the LCD panel, a back light unit on a lower part of the LCD panel having a light guide plate and at least two light emitting elements in the same plane with the light guide plate on opposite sides of the light guide plate and means for controlling the at least two light emitting elements such that the at least two light emitting elements are turned on and off alternately with respect to each other.

It is to be understood that both the foregoing general description and the following detailed description are exemplary and explanatory, and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENTS

Reference will now be made in detail to the embodiments of the present invention, examples of which are illustrated in the accompanying drawings.

Figure 1:
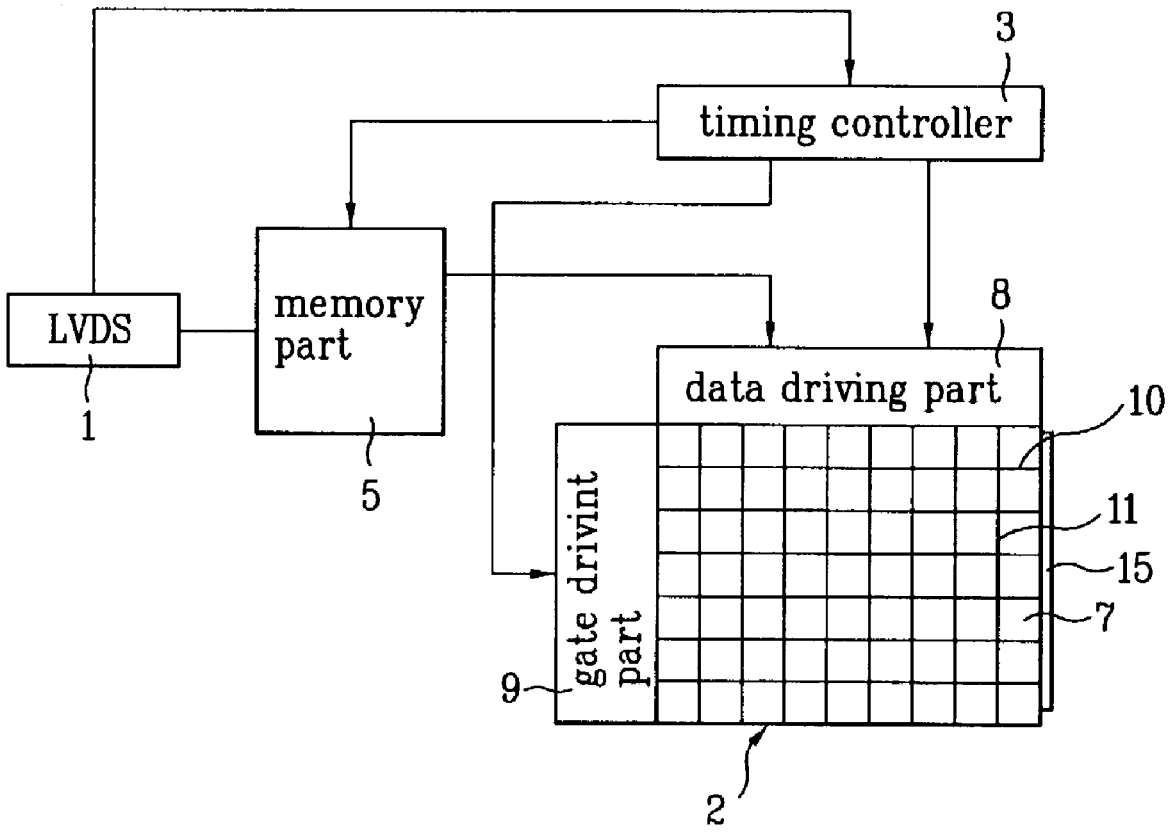
FIG. 1 Related Art
FIG. 1 illustrates a block diagram of a related art LCD.
Figure 2:
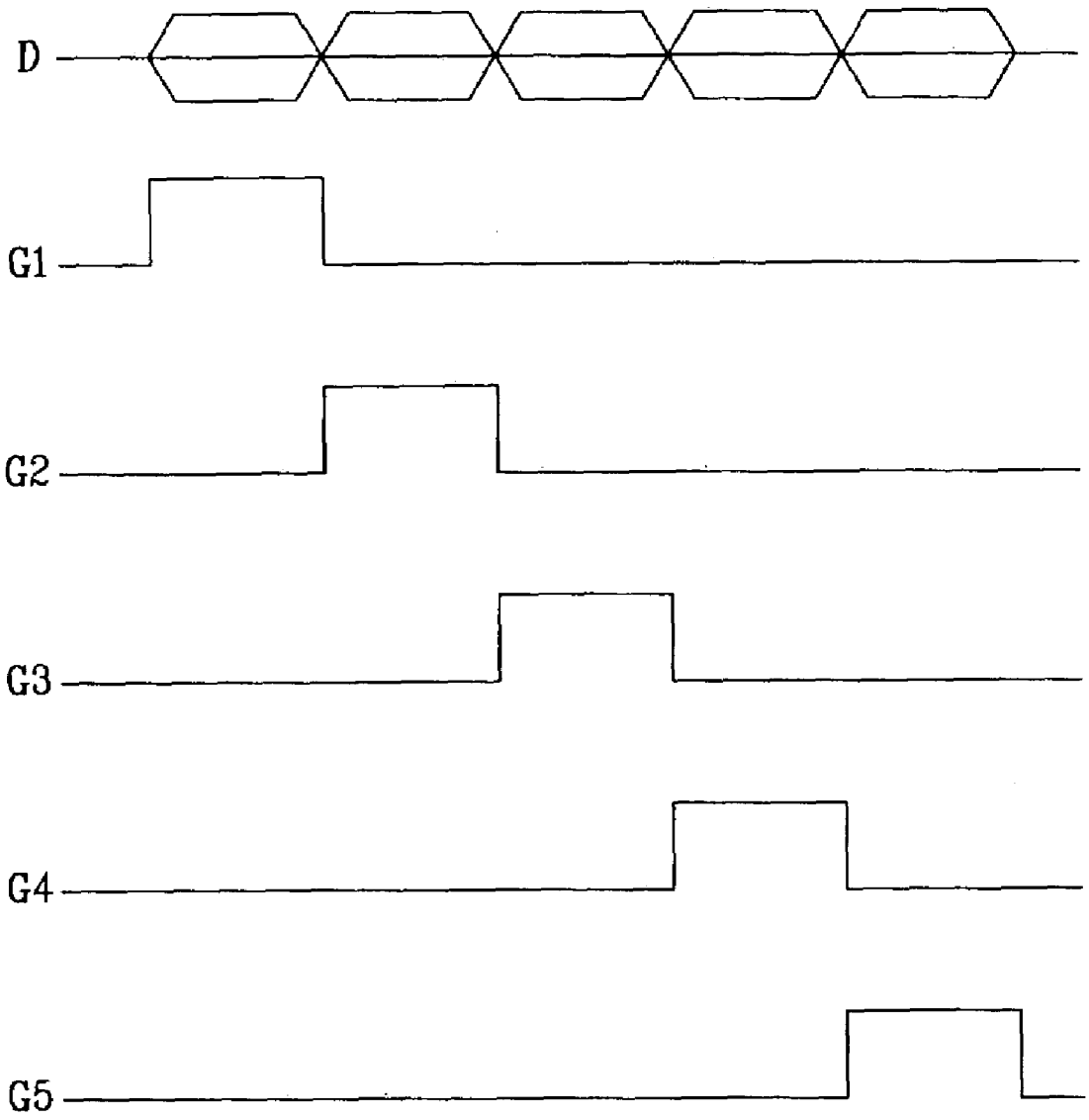
FIG. 2 Related Art
FIG. 2 depicts a timing diagram for the related art LCD illustrated in FIG. 1.
Figure 3:
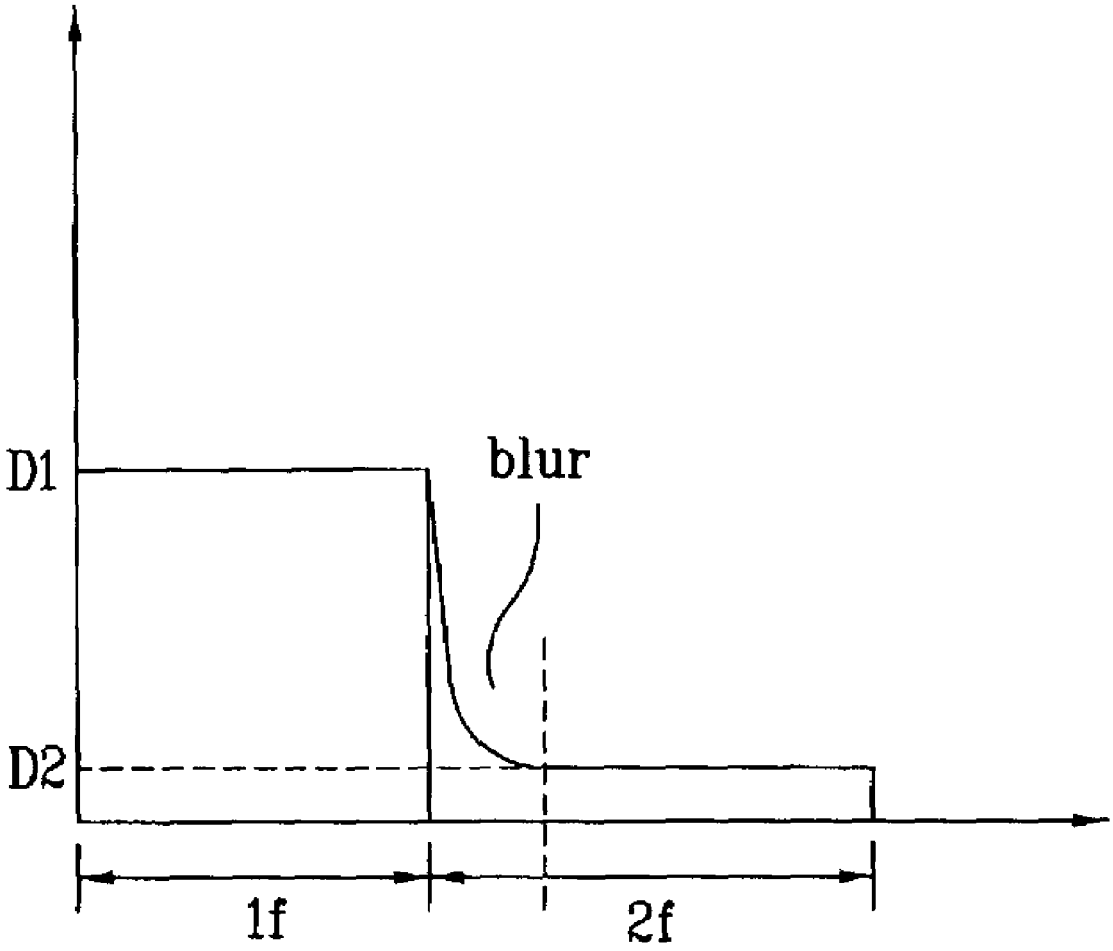
FIG. 3 Related Art
FIG. 3 illustrates the response of a cell changing from one data state to another data state.
Figure 4A:
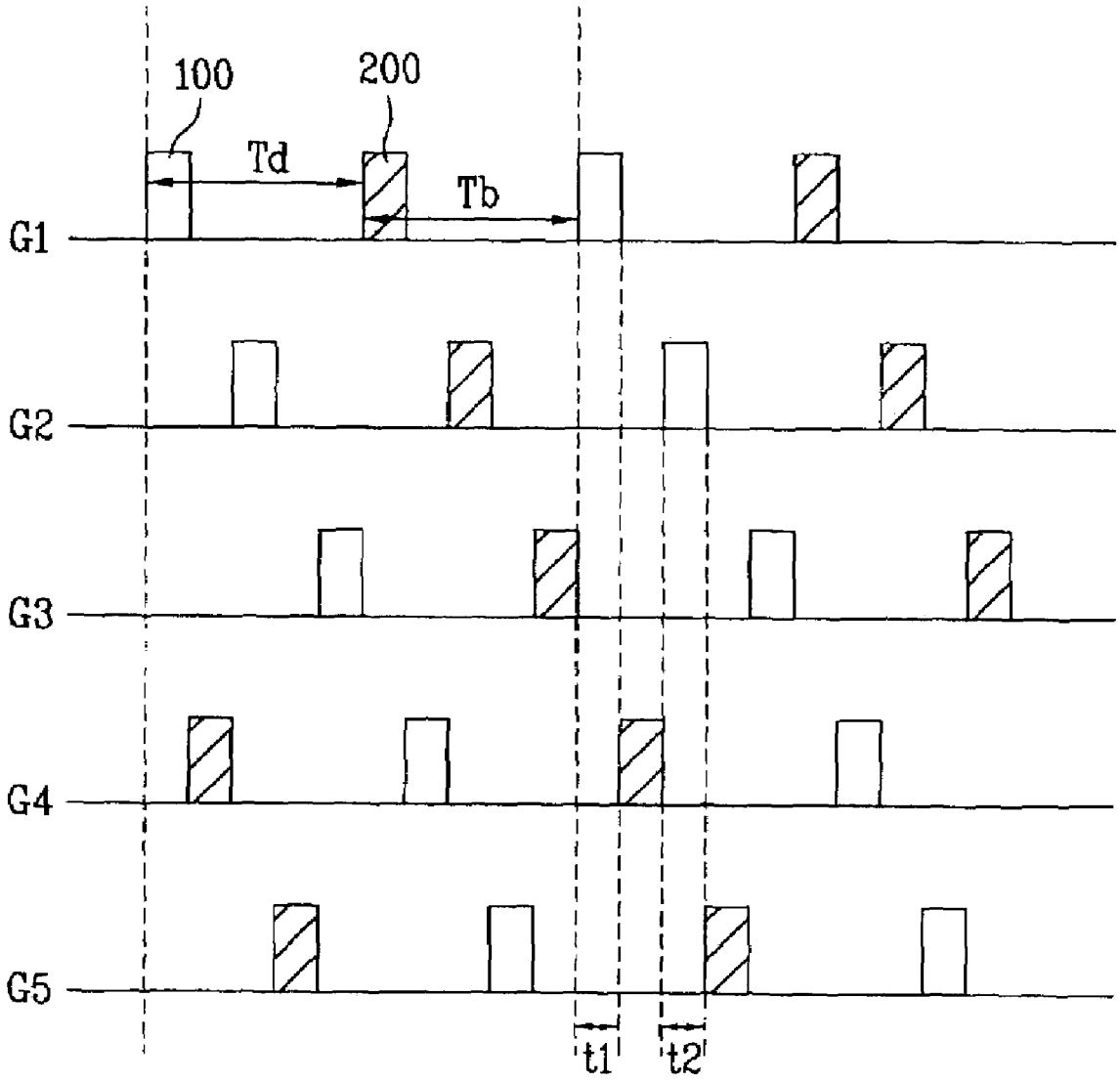
FIG. 4A illustrates a timing diagram for explaining a method for operating an LCD in accordance with an embodiment of the present invention.

FIG. 4A illustrates a timing diagram for explaining a method for operating an LCD in accordance with an embodiment of the present invention. Though not shown in the drawings, the LCD in accordance with an embodiment of the present invention includes a timing controller having control means (not shown) for dividing one frame period into a real data sustain period Td, which starts with a first gate signal, and a black data sustain period Tb, which starts with a second gate signal. More particularly, a first gate signal is sequentially applied to a plurality of gate lines and then a second gate signal is applied sequentially to the plurality of gate lines after a set time period from the first gate signal within a frame period. Thus, the timing controller provides two gate signals to each gate line such that relevant data signals are applied to a gate line during one frame. The timing controller can also adjust a ratio of the real data sustain period Td and the black data sustain period Tb.

Although the timing of a gate signal, such as a scanning signal, varies with resolution of the LCD panel, the timing diagrams for operating an LCD in accordance with an embodiment of the present invention will be explained based on five scanning signals to simplify explanation. FIG. 4A illustrates a timing diagram for explaining a method for operating an LCD in accordance with an embodiment of the present invention. Referring to FIG. 4A, each of the gate signals G1, G2, G3, G4 and G5 is divided into a first gate signal 100 and a second gate signal 200, wherein the first gate signal 100 starts the real data sustain period Td and the second gate signal 200 starts the black data sustain period Tb. Actual picture data signals are provided to data lines in the real data sustain period Td during the first gate signal and reset data signals are provided to data lines in the black data sustain period Tb during the second gate signal to drive cells of a panel during one frame period along a gate line. As shown in FIG. 4A a first gate signal starting a real data period followed by a second gate signal starting a black data period is applied sequentially to the gate lines of a panel. By adjusting a ratio of the real data sustain period Td to the black data sustain period Tb according to a luminance of the screen, an panel can be operated as an HDTV with reduced blur.

Figure 4B:
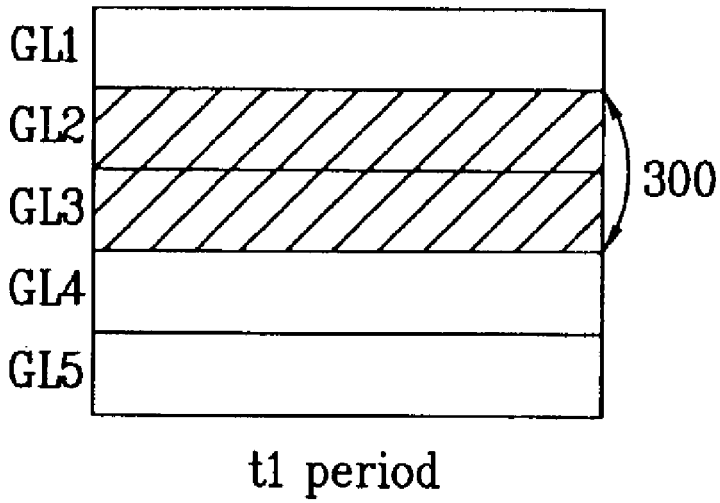
FIG. 4B illustrates the display along gate lines GL1, GL2, GL3, GL4 and GL5 during a time period t1 in FIG. 4A.
Figure 4C:
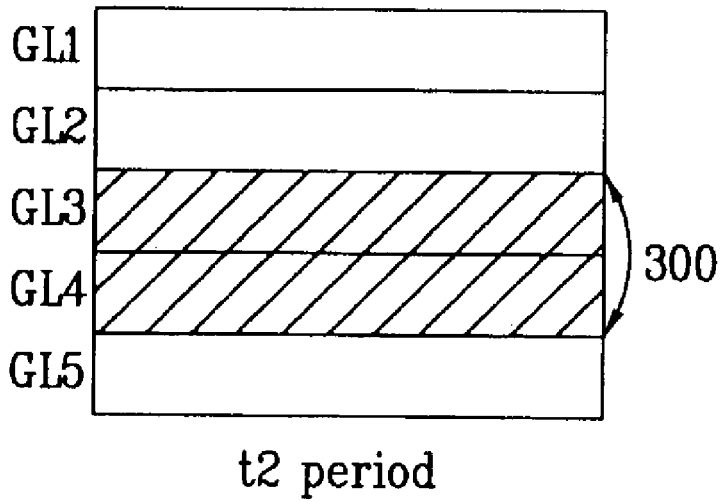
FIG. 4C illustrates the display along gate lines GL1, GL2, GL3, GL4 and GL5 during a time period t2 following the time period t1 in FIG. 4B FIGS. 5A–5C are front views of a panel using a method for operating an LCD in accordance with an embodiment of the present invention using a back light unit having a light guide plate and at least two light emitting elements.

A method for operating an LCD in accordance with an embodiment of the present invention will be explained in reference to FIG. 4B and FIG. 4C. More particularly, FIG. 4B illustrates the display along gate lines GL1, GL2, GL3, GL4 and GL5 during a time period t1 and FIG. 4C illustrates the display along gate lines GL1, GL2, GL3, GL4 and GL5 during a time period t2 following the time period t1 in FIG. 4B. For purposes of discussion, it is assumed that a period of the first gate signal 100 that is provided to a first gate line during a frame period is the time period of t1, as shown in FIG. 4A. Further, it is assumed that a period of the first gate signal 100 that is provided to the next gate line after the first gate line during a frame period is the time period of t2, as shown in FIG. 4A.

As shown in FIG. 4B, in the time period t1, actual picture data is provided and displayed along pixels connected to the first gate line GL1 such that gray scales corresponding to actual picture data signals are displayed, a black state 300 from reset signals is displayed along pixels connected to the second gate line GL2 as a result of a second gate signal 200 from a prior frame period. Meanwhile, a black state 300 from reset signals is displayed along pixels connected to the third gate line GL3 as a result of a second gate signal 200 from a prior frame period. In addition, actual picture data is displayed along pixels connected to the fourth gate line GL4 as a result of a first gate signal 100 from a prior frame such that gray scales corresponding to actual picture data signals are displayed. Furthermore, actual picture data signals are displayed along pixels connected to the fifth gate line GL5 as a result of a first gate signal 100 from a prior frame period such that gray scales corresponding to the actual picture data signals are displayed.

In the next time period t2 as shown in FIG. 4C, actual picture data of the t1 time period is displayed along pixels connected to the first gate line GL1 such that gray scales corresponding to the actual picture data signals are displayed, and actual picture data signals are provided and displayed along pixels connected to the second gate line GL2 as a result of a first gate signal 100 such that gray scales corresponding to the actual picture data signals are displayed. Meanwhile, a black state 300 from reset signals is displayed along pixels connected to the third gate line GL3 as a result of a second gate signal 200 from a prior frame period. In addition, a black state 300 from reset data signals is provided and displayed along pixels connected to a fourth gate line GL4 as a result of a second gate signal 200 from the present frame period. Furthermore, actual picture data signals are displayed along pixels connected to the fifth gate line GL5 as a result of a first signal 100 from a prior frame period such that gray scales corresponding to the actual picture data signals are displayed.

There is no use for the light from the back light unit in the black state, since light from the back light unit (not shown) which illuminates the pixels on the backside of an LCD panel is blocked or absorbed. Accordingly, the energy used to generate the light is wasted or causes excessive heat that effects the performance of the liquid crystal. Furthermore, a slight amount of light leakage can occur through a cell that is suppose to be reset or turned off, which can produce an appearance of blur. Therefore, turning off light emitting elements during a reset period increases energy efficiency, prevents a build-up of heat and reduces the appearance of blur.

Figure 5A:
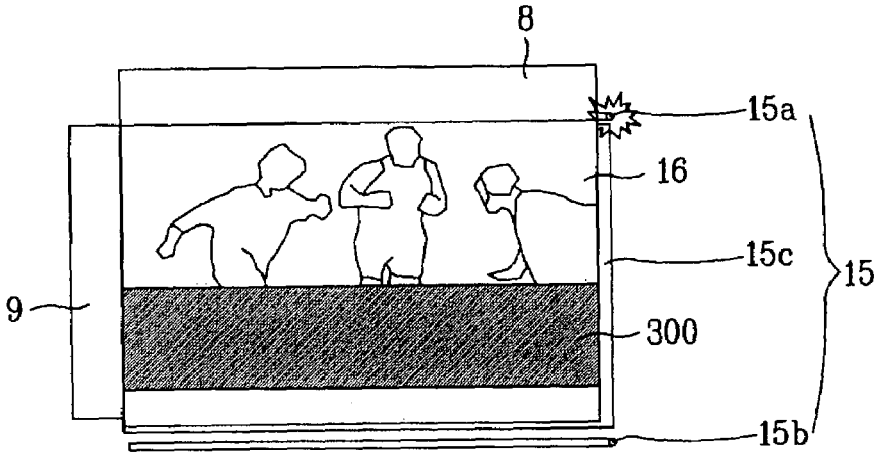
Figure 5B:
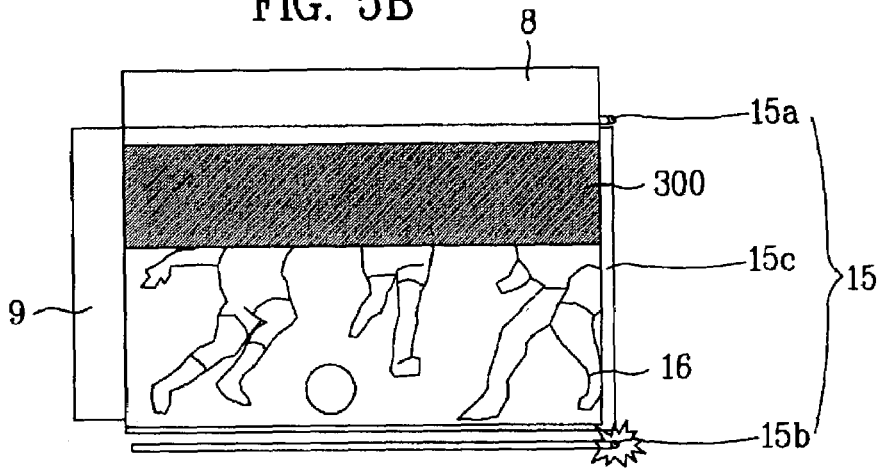
Figure 5C:
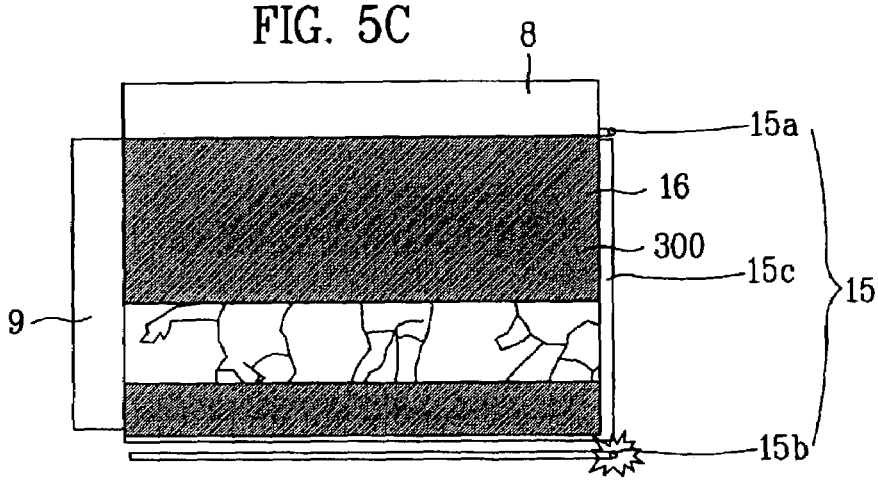

FIGS. 5A–5C are front views of a panel using a method for operating an LCD in accordance with an embodiment of the present invention using a back light unit having a light guide plate and at least two light emitting elements positioned at an upper side of the light guide plate and at a lower side of the light guide plate. As shown in FIGS. 5A–5C, the back light unit 15 includes an upper light emitting element 15*a* at one edge of the LCD panel 16 and a lower light emitting element 15*b* at the other edge of the LCD panel 16 that both transmit light to the LCD panel 16 via a light guide plate 15*c* on the back side of the LCD panel. The light emitting elements 15*a* and 15*b* are in the same plane as the light plate 15*c*.

As shown in FIG. 5A, the LCD panel 16 is divided into at least one picture region for displaying a picture signal, and at least one black region for displaying a black signal at a point in time. The boundary between the picture region and the black region on the LCD panel 16 is parallel to the gate lines (not shown). The light emitting element 15*a* that is most adjacent to the picture region in FIG. 5A is turned on while the other light emitting element 15*b* is turned off.

As shown in FIG. 5B at a subsequent point in time, the picture region and the black region displayed on the LCD panel appears to move in a vertical direction across the LCD. However, the light emitting element 15*b* that is most adjacent to the picture region in FIG. 5B is turned on while the other light emitting element 15*a* is turned off. Thus, as shown in FIGS. 5A and 5B, a light emitting element 15*a* or 15*b* on a side of the LCD panel 16 having relatively more of the picture region than an other side of the LCD panel is turned on while the light emitting element 15*b* or 15*a* on a side of the LCD panel 16 having relatively less of the picture region than an other side of the LCD panel 16 is turned off.

As shown in FIG. 5C, if a ratio of the black region is increased by adjusting the set time period such that a ratio of a size of picture region to the black region on the LCD is increased, the lower light emitting element 15*b* that is most adjacent to the picture region in FIG. 5C is turned on while the upper light emitting element 15*a* is turned off. Therefore, the upper lighting element has a cooling time period such that light efficiency is improved and the life of the lighting element is extended.

Figure 6:
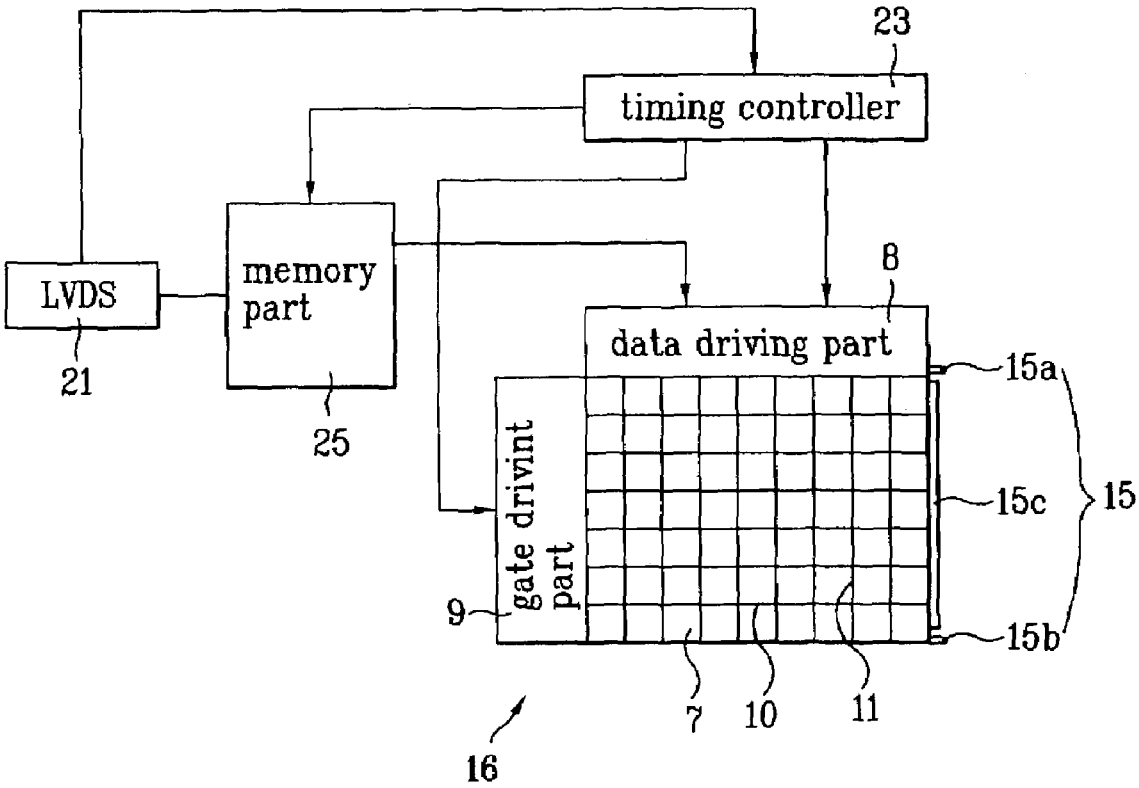
FIG. 6 is illustrates a block diagram of a LCD according to the present invention.

FIG. 6 is illustrates a block diagram of a LCD in accordance with the present invention. The present invention LCD shown in FIG. 6 is provided with a Low Voltage Differential Signaling (LVDS) module 21 for receiving a picture data for an LCD panel 2 and providing data enable signals, vertical synchronizing signals, horizontal synchronizing signals and a system clock to a timing controller 23. In addition, the LVDS module 21 provides picture data to a memory part 25. Further, the LVDS module 21 can also be used in controlling at least two light emitting elements that are spaced apart from each other and on the same plane in a lower part of the LCD panel 16 such that the at least two light emitting elements are turned on and off alternately with respect to each other. The LVDS module 21 can also be used in adjusting the set time period such that a ratio of a size of picture region to the black region on the LCD panel 16 at for subsequent points in time.

Data signals are provided to a data driving part 8 of the LCD panel 16 and the gate signals are provided to a gate driving part 9 of the LCD panel 16 by the timing controller 23 in response to the data enable signals, vertical synchronizing signals, horizontal synchronizing signals and the system clock. The data driving part provides data to the cells 7 of the LCD panel 16 while the gate driving part 9 drives gates of TFTs in the cells 7 of the LCD panel 16 such that cells 7 receive data. The memory part 25 receives the data signals from the timing controller part 23 and also receives picture data and black data from the LVDS 1. The picture data is R, G, and B data. Using the picture data and the data signals, the memory part 5 provides even and odd numbered signals required for driving data, such as picture data and black data, in the data driving part 8 of the LCD panel 16.

The LCD panel 16 is provided with a plurality of gate lines 10 and a plurality of data lines 11 formed in a matrix shape that define the cells 7 of the LCD panel 16. Each cell has a TFT (not shown) connected to a pixel electrode. A back light unit 15 includes a light guide plate 15*c*, an upper light emitting element 15*a* at one edge of the light guide plate 15*c* and a lower light emitting element 15*b* at the other edge of the light guide plate 15*c*. The upper and lower light emitting elements transmit light to the LCD panel 16 via the light guide plate 15*c* on the back side of the LCD panel 16. The data level or voltage value of the data supplied to the pixel electrode through the TFT determines the amount of light transmittance that will occur through the cell from the back light unit 15. The two light emitting elements are turned on and off alternately with respect to each other depending on the position of a picture region on the LCD panel 16. In the alternative, the lights can be controlled such that all of the light emitting elements are not on at the same time such that a light emitting element is always turned off momentarily for cooling purposes.

It will be apparent to those skilled in the art that various modifications and variations can be made in the method for operating a liquid crystal display (LCD) of the present invention without departing from the spirit or scope of the invention. Thus, it is intended that the present invention cover the modifications and variations of this invention provided they come within the scope of the appended claims and their equivalents.

What is claimed is:

1. A liquid crystal display (LCD), comprising:

an LCD panel having a plurality of gate lines running in parallel in one direction and a plurality of data lines running in parallel perpendicular to the gate lines;

gate input drivers to provide gate signals to the gate lines of the LCD panel;

data input drivers to provide data signals to the data lines of the LCD panel; and a back light unit on a lower part of the LCD panel having a light guide plate and at least two light emitting elements in the same plane with the light guide plate on opposite sides of the light guide plate, wherein the at least two light emitting elements are turned on and off alternately with respect to each other.

2. The LCD according to claim 1, wherein the LCD panel is divided into at least one picture region for displaying a picture signal, and at least one black region for displaying a black signal at a time point.

3. The LCD according to claim 2, wherein a boundary between the picture region and the at least one black region on the LCD panel displayed at a point in time is parallel to the gate lines.

4. The LCD according to claim 3, wherein the picture region and the black region displayed on the LCD panel appears to move in a vertical direction across the LCD panel at subsequent points in time.

5. The LCD according to claim 2, wherein the light emitting element most adjacent to the picture region is turned on while the other light emitting element is turned off.

6. The LCD according to claim 2, wherein a light emitting element on a side of the LCD panel having relatively more of the picture region than another side of the LCD panel is turned on, and a light emitting element on a side of the LCD panel having relatively less of the picture region than the other side of the LCD panel is turned off.

7. A method of operating an LCD, comprising the steps of:

providing a first gate signal to a plurality of gate lines sequentially, and a second gate signal to the plurality of the gate lines sequentially after a set time period from the first gate signal within a frame period;

providing picture data signals to a plurality of pixels in synchronization with the first gate signals provided to the plurality of pixels;

providing black data signals to the plurality of pixels in synchronization with the second gate signals provided to the plurality of pixels; and controlling at least two light emitting elements that are spaced apart from each other and on the same plane in a lower part of the LCD panel such that the at least two light emitting elements are turned on and off alternately with respect to each other.

8. The method according to claim 7, wherein the LCD panel is divided into at least one picture region for displaying a picture signal from the picture data signals and at least one black region for displaying a black signal from the black data signals at a point in time.

9. The method according to claim 8, wherein a boundary between the picture region and the black region the LCD panel displays at a point in time is parallel to the gate lines.

10. The method according to claim 8, wherein the picture region and the black region displayed on the LCD panel move in a vertical direction at subsequent points in time.

11. The method according to claim 8, wherein the light emitting element most adjacent to the picture region is turned on while the other light emitting element is turned off.

12. The method according to claim 8, wherein a light emitting element on a side of the LCD panel having relatively more of the picture region than another side of the LCD panel is turned on, and a light emitting element on a side of the LCD panel having relatively less of the picture region than the other side of the LCD panel is turned off.

13. The method according to claim 7, further comprising the step of adjusting the set time period such that a ratio of a size of picture region to the black region on the LCD panel is changed for subsequent points in time.

14. A liquid crystal display (LCD), comprising:

an LCD panel having a plurality of gate lines running in parallel in one direction and a plurality of data lines running in parallel perpendicular to the gate lines;

gate input drivers to provide gate signals to the gate lines of the LCD panel;

data input drivers to provide data signals to the data lines of the LCD panel;

a back light unit on a lower part of the LCD panel having a light guide plate and at least two light emitting elements in the same plane with the light guide plate on opposite sides of the light guide plate; and means for controlling the at least two light emitting elements such that the at least two light emitting elements are turned on and off alternately with respect to each other.

15. The LCD according to claim 14, wherein the LCD panel is divided into at least one picture region for displaying a picture signal, and at least one black region for displaying a black signal at a time point.

16. The LCD according to claim 14, wherein a boundary between the picture region and the at least one black region on the LCD panel displayed at a point in time is parallel to the gate lines.

17. The LCD according to claim 14, wherein the picture region and the black region displayed on the LCD panel appears to move in a vertical direction across the LCD panel at subsequent points in time.

* * * * *